US009303864B2

(12) United States Patent
Yen

(10) Patent No.: US 9,303,864 B2
(45) Date of Patent: Apr. 5, 2016

(54) LED LIGHT FOR CEILING FAN

(71) Applicant: Teng-Chia Yen, Changhua (TW)

(72) Inventor: Teng-Chia Yen, Changhua (TW)

( * ) Notice: Subject to any disclaimer, the term of this patent is extended or adjusted under 35 U.S.C. 154(b) by 88 days.

(21) Appl. No.: 14/474,287

(22) Filed: Sep. 1, 2014

(65) Prior Publication Data

US 2014/0369040 A1 Dec. 18, 2014

(51) Int. Cl.

| | |
|---|---|
| ***F21V 33/00*** | (2006.01) |
| ***F21V 29/70*** | (2015.01) |
| ***F21V 29/83*** | (2015.01) |
| *F21Y 101/02* | (2006.01) |
| *F21Y 103/00* | (2006.01) |
| *F21Y 111/00* | (2006.01) |

(52) U.S. Cl.

CPC ..... *F21V 33/0096* (2013.01); *F21V 29/70* (2015.01); *F21V 29/83* (2015.01); *F21Y 2101/02* (2013.01); *F21Y 2103/003* (2013.01); *F21Y 2111/007* (2013.01)

(58) Field of Classification Search

CPC ..... F21Y 2103/003; F21Y 2111/007; F21V 33/0096; F21V 29/70; F21V 29/83

USPC ..... 362/96, 249.02, 294, 800

See application file for complete search history.

(56) References Cited

U.S. PATENT DOCUMENTS

| | | | | |
|---|---|---|---|---|
| 6,461,032 | B2 * | 10/2002 | McKinley | F04D 25/088 362/148 |
| 7,318,653 | B2 * | 1/2008 | Chien | F21S 8/035 362/95 |
| 2009/0175041 | A1 * | 7/2009 | Yuen | F21K 9/135 362/294 |
| 2009/0268464 | A1 * | 10/2009 | Zheng | F21V 29/004 362/249.02 |
| 2012/0081903 | A1 * | 4/2012 | Leung | F21V 7/0058 362/294 |
| 2012/0287636 | A1 * | 11/2012 | Chen | F21K 9/135 362/249.02 |
| 2013/0188352 | A1 * | 7/2013 | Boyer | F21S 8/02 362/235 |
| 2013/0343052 | A1 * | 12/2013 | Yen | F21V 33/0096 362/235 |

* cited by examiner

*Primary Examiner* — Laura Tso

(57) ABSTRACT

A light fixture is provided with a light seat including four spaced, upward inclined sides and holes arranged along a bottom edge of each side, insulators fastened in the holes respectively, LED arrays each including LEDs, and wires each passing through the hole to interconnect a power source and the LED array; a lampshade secured to the light seat; and a centrally raised cover comprising a threaded fastening assembly for securing the cover to the light seat, and through holes disposed along edges as heat sinks which are in close proximity to a predetermined number of the LED arrays.

1 Claim, 7 Drawing Sheets

LED LIGHT FOR CEILING FAN

BACKGROUND OF THE INVENTION

1. Field of the Invention

The invention relates to light-emitting diode (LED) lights and more particularly to an LED light fixture for mounting to a ceiling fan.

2. Description of Related Art

Ceiling fans are common in businesses, such as restaurants, lounges, retail stores, places of assembly, personal residences, etc. Ceiling fans are installed to aid in the movement of air to keep the environment more comfortable.

A conventional ceiling fan A is shown in FIG. 1 and comprises a plurality of fan blades A1. A lamp B is attached to the ceiling fan A from below and comprises a plurality of light bulbs B1.

However, a drawback has been found in the typical ceiling fan and lamp combination. In detail, hot air rather than cold air is blown downward because high heat generated by the light bulbs B1 is driven downward by the air flows produced by the fan blades A1. Thus, people may feel warm rather than cool when staying in the room installed with the ceiling fan and lamp combination.

Thus, the need for improvement still exists.

SUMMARY OF THE INVENTION

It is therefore one object of the invention to provide a light fixture comprising a light seat comprising four spaced, upward inclined sides and a plurality of holes arranged along a bottom edge of each side, a plurality of insulators fastened in the holes respectively, a plurality of LED arrays each including a plurality of LEDs, and a plurality or wires each passing through the hole to interconnect a power source and the LED array; a lampshade secured to the light seat; and a centrally raised cover comprising a threaded fastening assembly for securing the cover to the light seat, and a plurality of through holes disposed along edges as heat sinks which are in close proximity to a predetermined number of the LED arrays.

The above and other objects, features and advantages of the invention will become apparent from the following detailed description taken with the accompanying drawings.

DETAILED DESCRIPTION OF THE INVENTION

Figure 1:
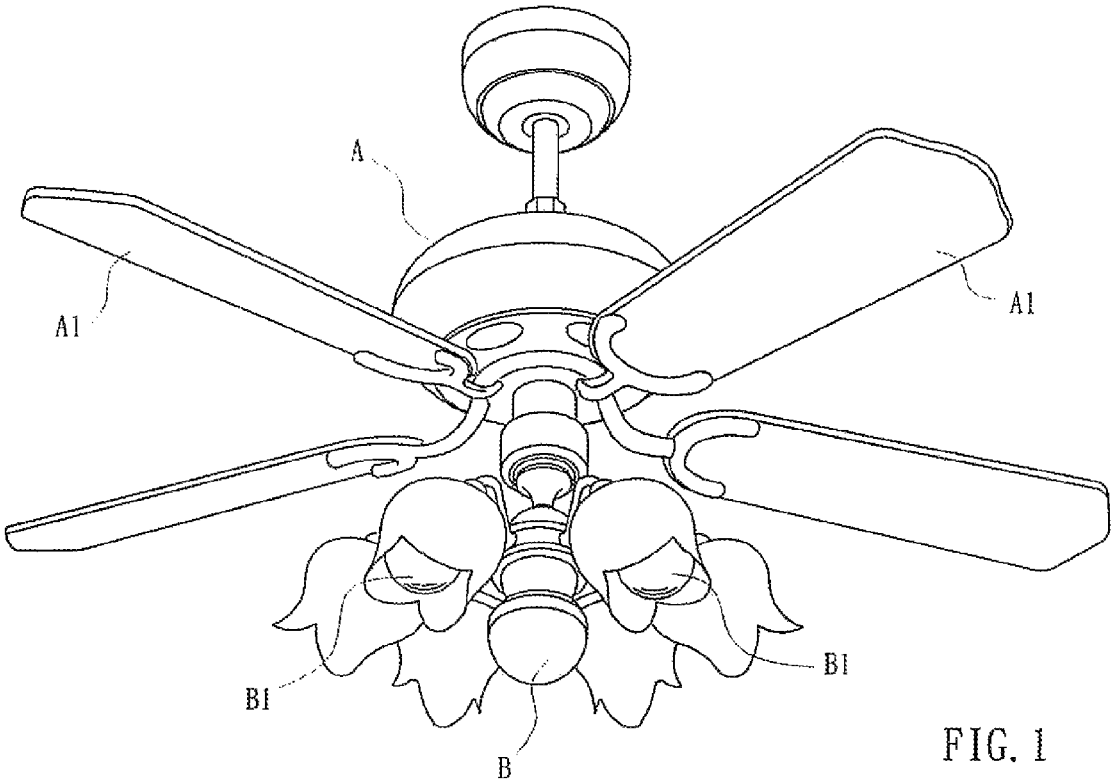
FIG. 1 PRIOR ART
FIG. 1 is a perspective view of a conventional ceiling fan and lamp combination.
Figure 2:
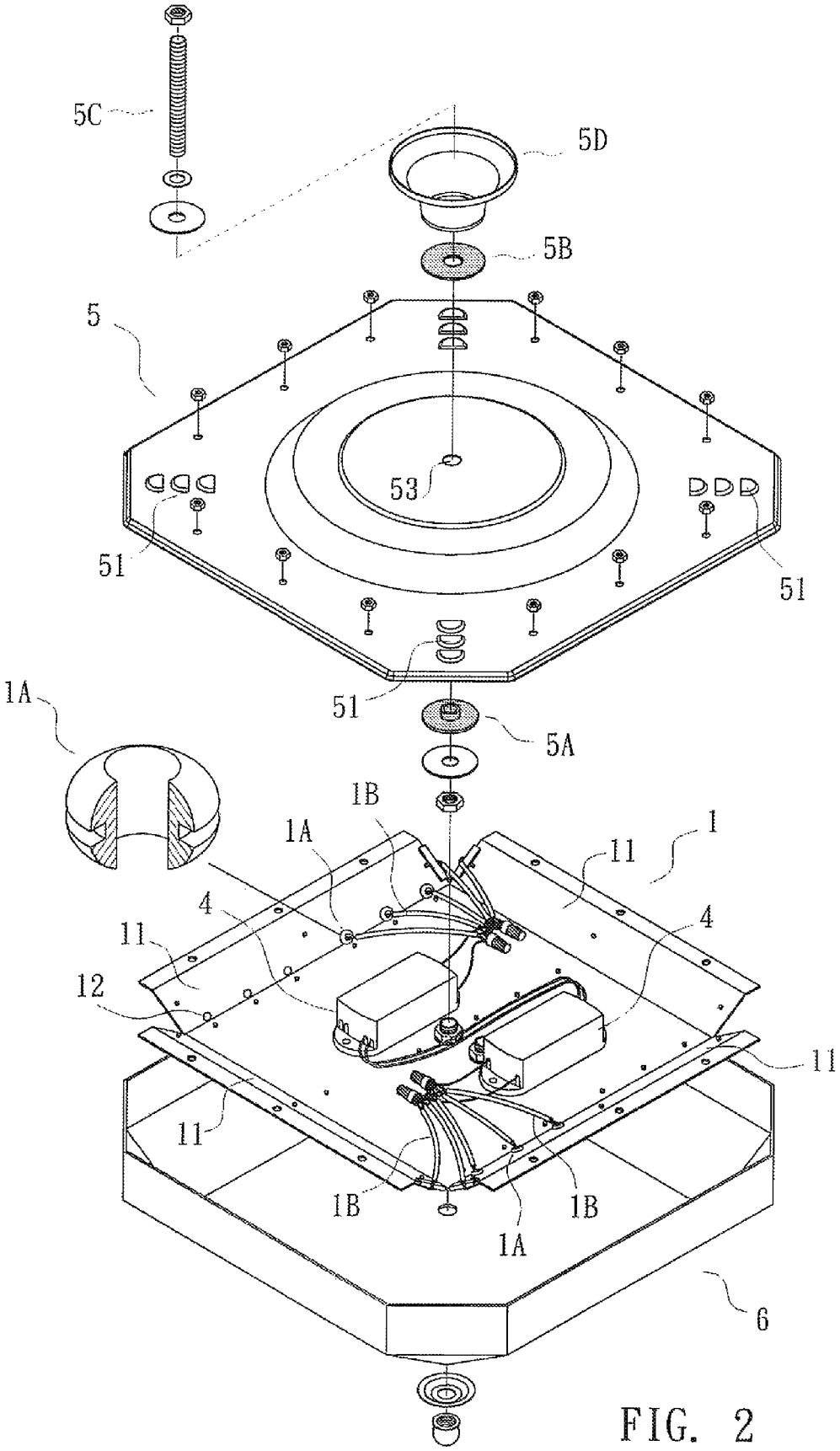
FIG. 2 is an exploded view of an LED light according to a first preferred embodiment of the invention.
Figure 3:
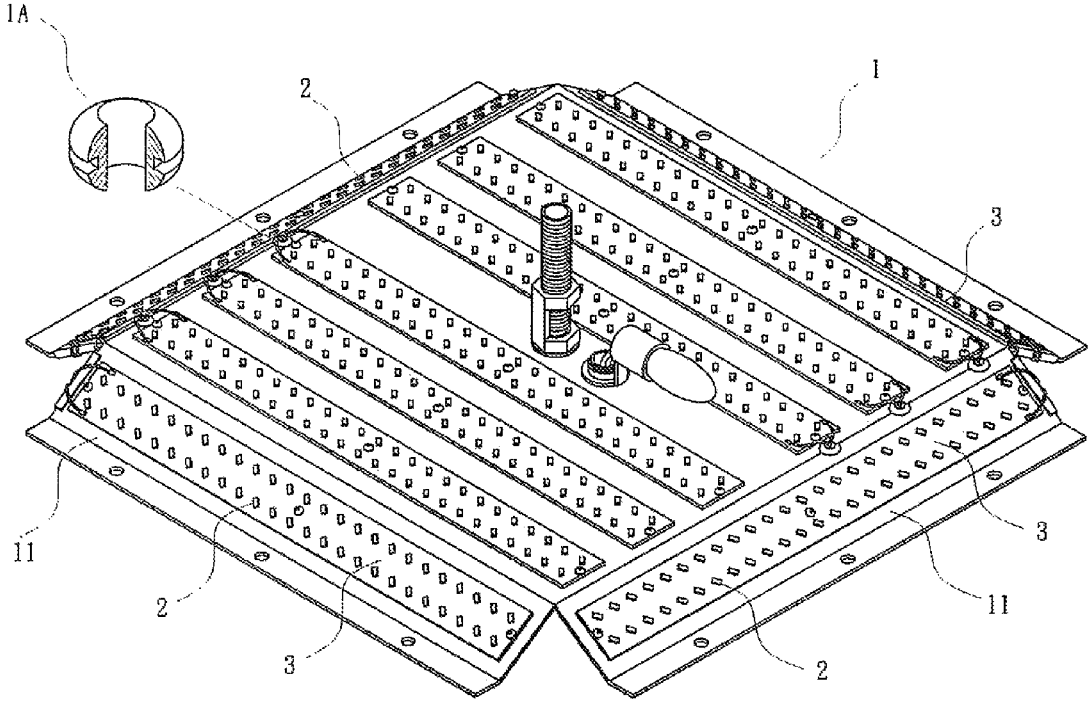
FIG. 3 is a perspective view of the light seat.
Figure 4:
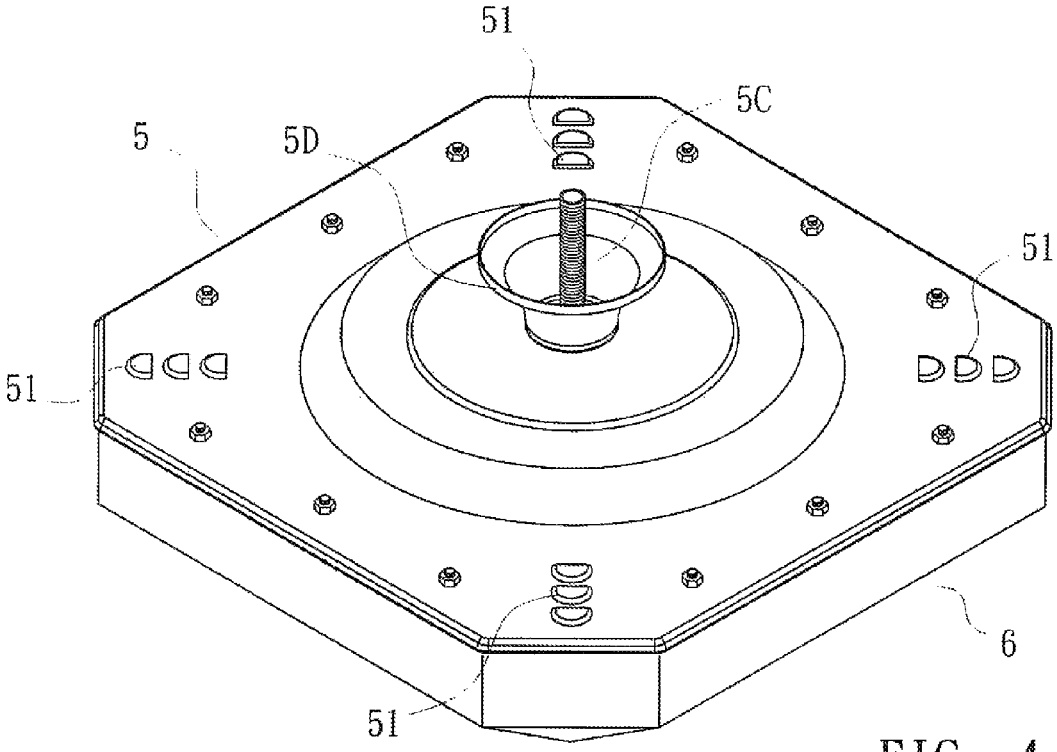
FIG. 4 is a perspective view of the assembled LED light.
Figure 5:
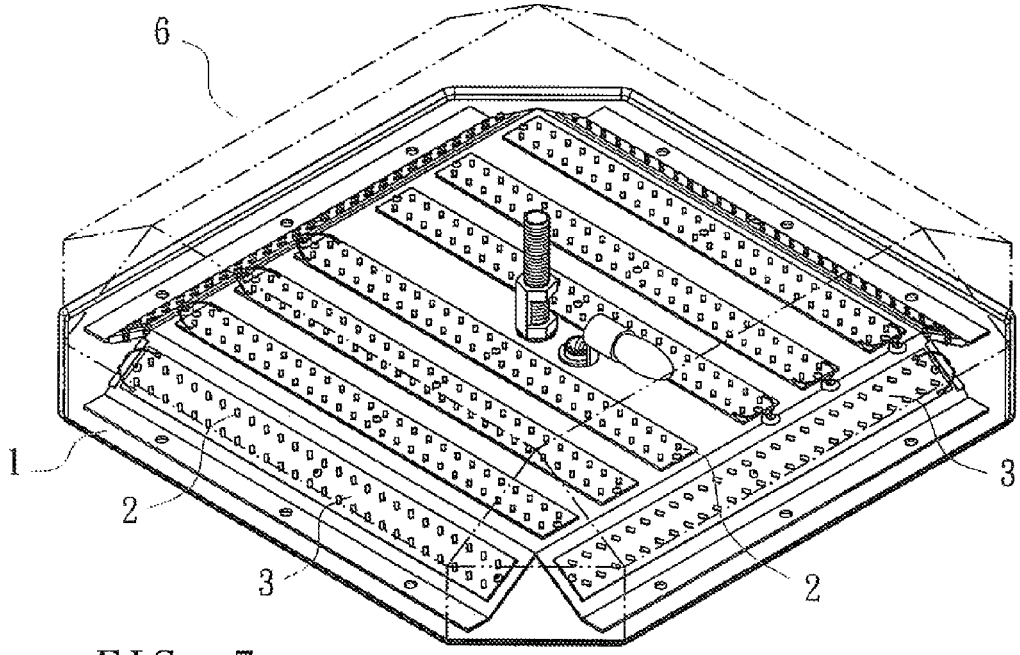
FIG. 5 is another perspective view of the assembled LED light viewing from below.
Figure 7:
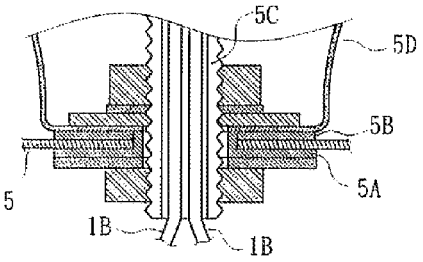
FIG. 7 is an enlarged view showing a joining portion of the fitting member and the cover in FIG. 6.
Figure 6:
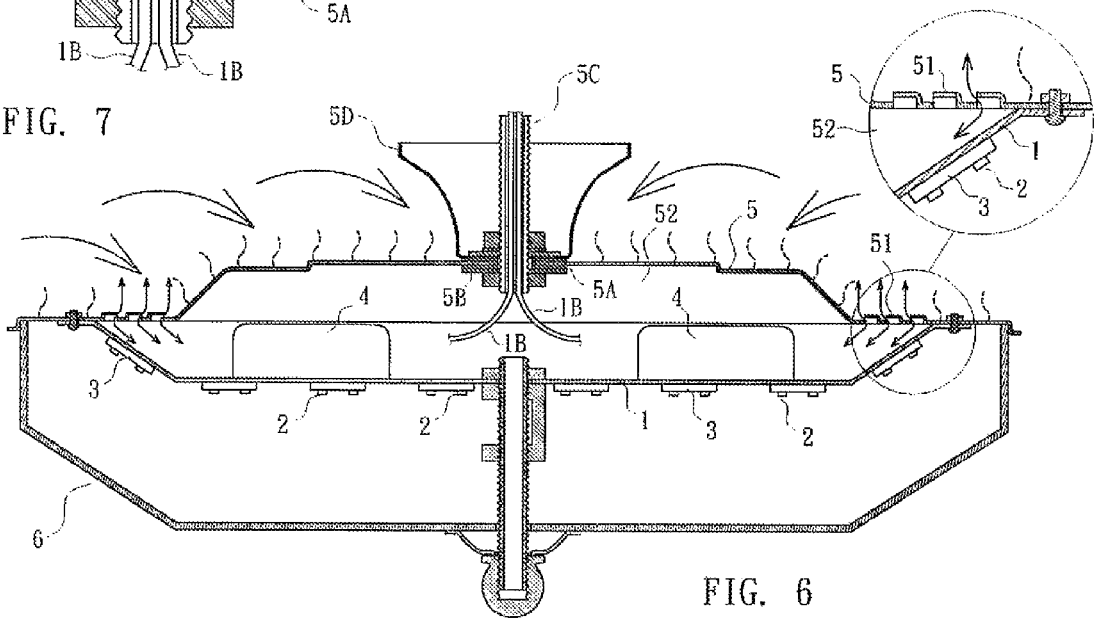
FIG. 6 is a longitudinal sectional view of the LED light shown in FIG. 5 in operation.
Figure 8:
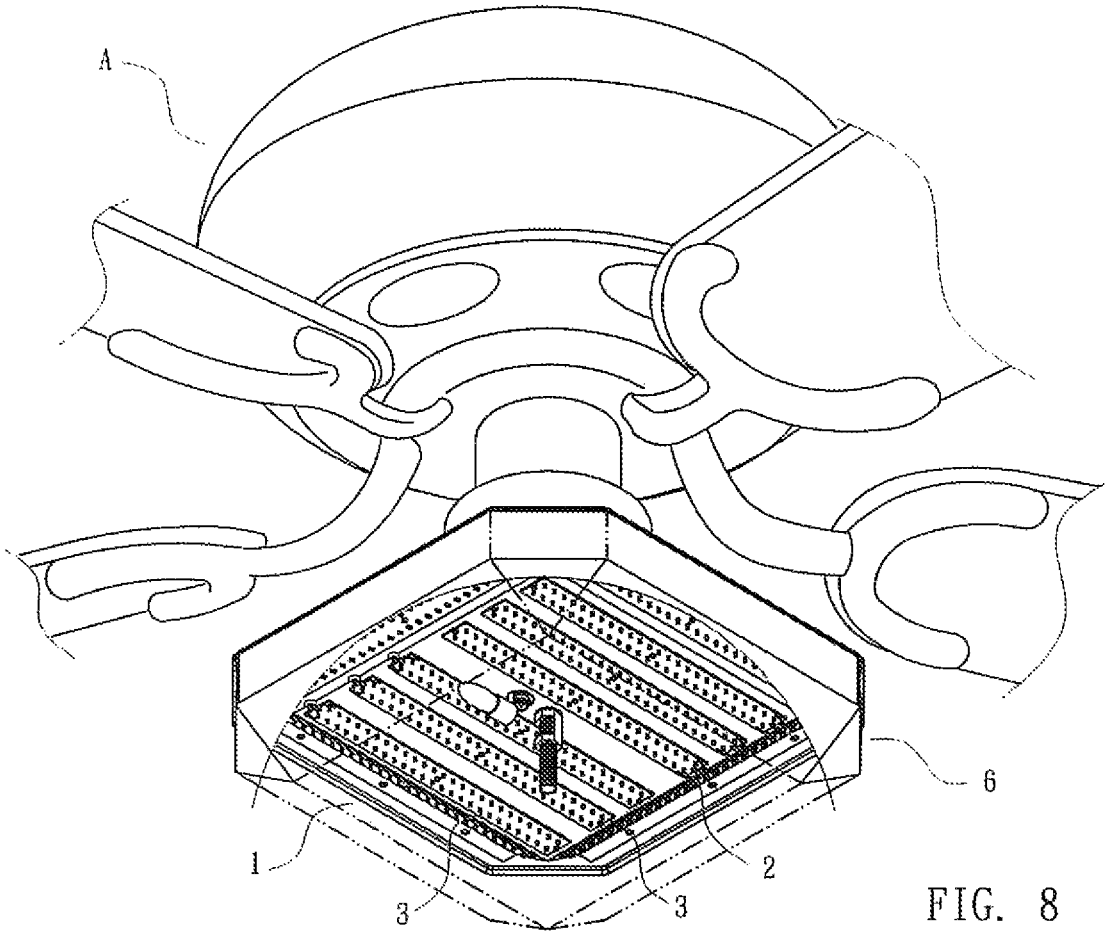
FIG. 8 is a perspective view of the LED light mounted to a typical ceiling fan from below.

Referring to FIGS. 2 to 8, an LED light for mounting to a ceiling fan A in accordance with a first preferred embodiment of the invention comprises the following components as discussed in detail below.

A rectangular light seat 1 comprises four spaced, upward inclined sides 11 and a plurality of holes 12 arranged along a bottom edge of each side 11. A plurality of insulators 1A each are fastened in the hole 12. A plurality of LED arrays 3 are shaped as an oblong plate. Each LED array 3 is provided with a plurality of LEDs 2 thereon. Six of the LED arrays 3 are spaced in parallel on the bottom of the light seat 1. The remaining four LED arrays 3 are disposed on the bottom of the four sides 11 of the light seat 1 respectively.

A plurality or wires 1B each pass through the hole 12 to have one end electrically interconnect one of two AC (alternating current) to DC (direct current) adaptors 4 mounted on the top of the light seat 1. Each of the LEDs 2 are electrically connected to the other end of the wire 1B. The AC to DC adaptor 4 is electrically connected to an external power source (e.g., 120V wall outlet).

A centrally raised cover 5 comprises a lower space 52, a plurality of through holes 51 disposed along the edge as heat sinks, and a threaded fastener 5C driven through a hollow fitting member 5D, a first insulator washer 5B, a central hole 53 of the cover 5, and a second insulator washer 5A to secure onto the top of the light seat 1, i.e., the cover 5 and the light seat 1 being secured together. The wires 1B pass through the hollow fitting member 5A. A lampshade 6 is secured to the light seat 1 (see FIG. 5) and together they are mounted under the ceiling fan A (see FIGS. 6 and 8). The LEDs 2 are mounted on the bottom surface of the light seat 1.

The heat sinks 51 are in close proximity to the LED arrays 3 which are disposed on the bottom of the four sides 11 of the light seat 1 respectively. The insulating members including insulators 1A and first and second insulator washers 5B, 5A can avoid electrical shock. The LEDs 2 mounted on the upward inclined sides 11 can increase illumination rage in both downward and upward directions. Heat generated by the LEDs 2 can be quickly, effectively dissipated by the heat sinks 51 in a lighting operation (see FIG. 6).

Figure 9A:
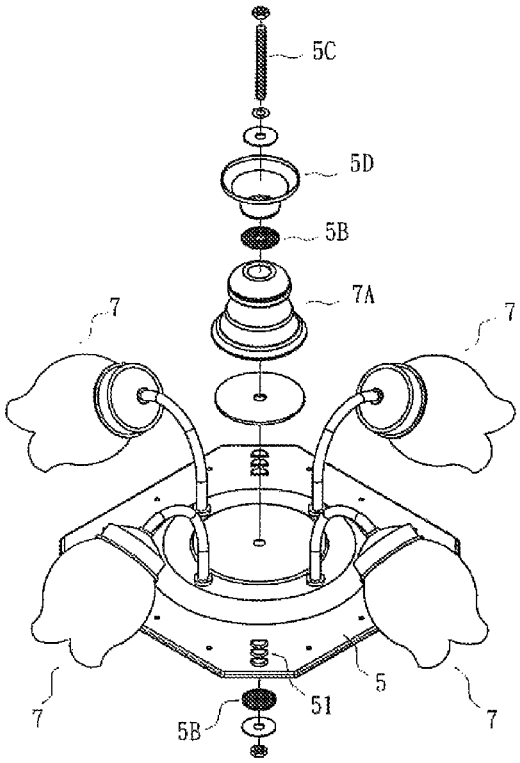
FIG. 9A is an exploded perspective view of the cover mounted with a plurality of lamps according to a second preferred embodiment of the invention.
Figure 9B:
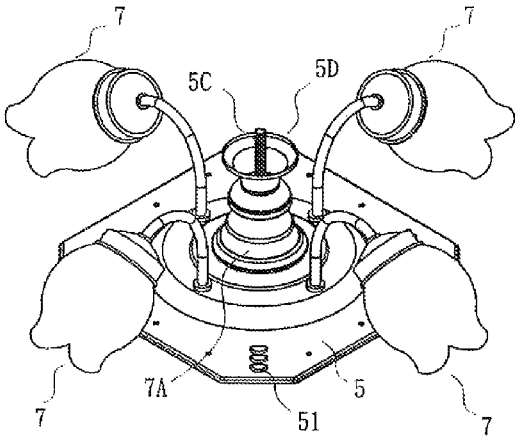
FIG. 9B is a perspective view of the assembled cover and the lamps.

Referring to FIGS. 9A and 9B, a light for mounting to a ceiling fan in accordance with a second preferred embodiment of the invention is shown. The characteristics of the second preferred embodiment are substantially the same as that of the first preferred embodiment except the following: The LEDs are replaced by a plurality of light bulbs 7. A second fitting member 7A is provided under the first insulator washer 5B.

While the invention has been described in terms of preferred embodiments, those skilled in the art will recognize that the invention can be practiced with modifications within the spirit and scope of the appended claims.

What is claimed is:

1. A light fixture comprising:

a light seat comprising four spaced, upward inclined sides and a plurality of holes arranged along a bottom edge of each side, a plurality of insulators fastened in the holes respectively, a plurality of LED arrays each including a plurality of LEDs, and a plurality or wires each passing through the hole to interconnect a power source and one of the LED arrays;

a lampshade secured to the light seat; and a centrally raised cover comprising a threaded fastening assembly for securing the cover to the light seat, and a plurality of through holes disposed along edges as heat sinks which are in close proximity to a predetermined number of the LED arrays.

* * * * *